US012703926B2

(12) United States Patent
McHugh et al.

(10) Patent No.: US 12,703,926 B2
(45) Date of Patent: Aug. 11, 2026

(54) ELECTROPLATING SYSTEMS AND METHODS WITH INCREASED METAL ION CONCENTRATIONS

(71) Applicant: Applied Materials, Inc., Santa Clara, CA (US)

(72) Inventors: Paul R. McHugh, Kalispell, MT (US); Forrest G. Reinhart, Kalispell, MT (US); Gregory J. Wilson, Kalispell, MT (US); Kwan Wook Roh, Kalispell, MT (US); Kyle M. Hanson, Kalispell, MT (US); James E. Brown, Kalispell, MT (US); David J. Reis, Kalispell, MT (US)

(73) Assignee: Applied Materials, Inc., Santa Clara, CA (US)

( * ) Notice: Subject to any disclaimer, the term of this patent is extended or adjusted under 35 U.S.C. 154(b) by 558 days.

(21) Appl. No.: 18/130,004

(22) Filed: Apr. 3, 2023

(65) Prior Publication Data

US 2023/0313406 A1 Oct. 5, 2023

Related U.S. Application Data

(60) Provisional application No. 63/327,264, filed on Apr. 4, 2022.

(51) Int. Cl.

| | |
|---|---|
| ***C25D 17/00*** | (2006.01) |
| ***C25D 3/38*** | (2006.01) |
| ***C25D 7/12*** | (2006.01) |

(52) U.S. Cl.

CPC ..... *C25D 17/002* (2013.01); *C25D 3/38* (2013.01); *C25D 7/12* (2013.01); *C25D 17/001* (2013.01)

(58) Field of Classification Search

CPC ..... C25D 7/12–123; C25D 17/001; H01L 21/2885; H01L 21/76873; H01L 2224/11462

See application file for complete search history.

(56) References Cited

U.S. PATENT DOCUMENTS

| | | | | |
|---|---|---|---|---|
| 10,011,919 | B2 | 7/2018 | Mayer et al. | |
| 2012/0138471 | A1* | 6/2012 | Mayer | C25D 21/12 204/275.1 |

(Continued)

FOREIGN PATENT DOCUMENTS

| | | | |
|---|---|---|---|
| CN | 101962796 | A | 2/2011 |
| CN | 113818055 | A | 12/2021 |

(Continued)

OTHER PUBLICATIONS

Lou et al., Electroplating, Encyclopedia of Chem. Proc. (Year: 2006).*

(Continued)

*Primary Examiner* — Hosung Chung

(74) *Attorney, Agent, or Firm* — Kilpatrick Townsend & Stockton LLP

(57) ABSTRACT

Electroplating methods may include providing an electrolyte feedstock comprising copper to a first compartment of an electrochemical cell. The methods may include providing an acidic solution to a second compartment of the electrochemical cell. The first compartment and second compartment may be separated by a membrane. The methods may include applying a current to an anode of the electrochemical cell. The anode of the electrochemical cell may be disposed proximate the first compartment and across from the membrane. The methods may include forming an anolyte and catholyte precursor.

8 Claims, 4 Drawing Sheets

(56) References Cited

U.S. PATENT DOCUMENTS

| | | | | |
|---|---|---|---|---|
| 2016/0348265 | A1 | 12/2016 | Mayer et al. | |
| 2017/0016137 | A1* | 1/2017 | Wilson | C25D 17/06 |

FOREIGN PATENT DOCUMENTS

| | | | |
|---|---|---|---|
| EP | 1644557 | B1 | 11/2010 |
| JP | 7041795 | B1 | 3/2022 |
| TW | 201000683 | A | 1/2010 |
| TW | 201233852 | A | 8/2012 |
| TW | 201718953 | A | 6/2017 |
| TW | 202009330 | A | 3/2020 |
| WO | 2020042870 | A1 | 3/2020 |

OTHER PUBLICATIONS

Bard et al., Electrochemical Dictionary (Year: 2008).*
Application No. PCT/US2023/017387 , International Search Report and Written Opinion, Mailed on Aug. 2, 2023, 12 pages.
Office Action for Taiwan Application No. 112112874 dated Jul. 3, 2024, 4 pages.
Office Action for Taiwan Application No. 112112874 dated Jan. 11, 2024, 4 pages.
Korean Application No. 10-2024-7036753, Office Action mailed on May 12, 2026, 21 pages (11 pages of English Translation and 10 pages of original documents).

* cited by examiner

ELECTROPLATING SYSTEMS AND METHODS WITH INCREASED METAL ION CONCENTRATIONS

CROSS-REFERENCE TO RELATED APPLICATIONS

This application claims the benefit of, and priority to U.S. Provisional Application Ser. No. 63/327,264, filed Apr. 4, 2022, which is hereby incorporated by reference in its entirety for all purposes.

TECHNICAL FIELD

The present technology relates to electroplating operations in semiconductor processing. More specifically, the present technology relates to systems and methods that perform concentration and replenishment for electroplating systems.

BACKGROUND

Integrated circuits are made possible by processes which produce intricately patterned material layers on substrate surfaces. After formation, etching, and other processing on a substrate, metal or other conductive materials are often deposited or formed to provide the electrical connections between components. Because this metallization may be performed after many manufacturing operations, problems occurring during the metallization may create expensive waste substrates or wafers.

Electroplating is performed in an electroplating chamber with the device side of the wafer in a bath of liquid electrolyte, and with electrical contacts on a contact ring touching a conductive layer on the wafer surface. Electrical current is passed through the electrolyte and the conductive layer. Metal ions in the electrolyte plate out onto the wafer, creating a metal layer on the wafer. Electroplating chambers typically have consumable anodes, which are beneficial for bath stability and cost of ownership. For example, it is common to use copper consumable anodes when plating copper. The copper ions taken out of the plating bath are replenished by the copper removed from the anodes, thereby maintaining the metal ion concentration in the plating bath. Although effective at replacing plated metal ions, using consumable anodes requires a relatively complex and costly design to allow the consumable anodes to be replaced. Even more complexity is added when consumable anodes are combined with a membrane to avoid degrading the electrolyte, or oxidizing the consumable anodes during idle state operation.

Thus, there is a need for improved systems and methods that can be used to produce high quality devices and structures while protecting both the substrate and the plating baths. These and other needs are addressed by the present technology.

SUMMARY

Embodiments of the present technology may include electroplating methods. The methods may include providing a first portion of an electrolyte feedstock including copper to a first compartment of an electrochemical cell. The methods may include providing a second portion of the electrolyte feedstock or an acidic solution to a second compartment of the electrochemical cell. The first compartment and second compartment may be separated by a membrane. The methods may include applying a current to an anode of the electrochemical cell. The anode of the electrochemical cell may be disposed proximate the first compartment and across from the membrane. The methods may include forming an anolyte and catholyte precursor.

In some embodiments, the electrolyte feedstock may be characterized by a copper ion concentration of less than or about 50.0 g/L. The acidic solution may be characterized by an acid concentration of less than or about 110.0 g/L. The anolyte and catholyte precursor may be characterized by a copper ion concentration of greater than or about 70.0 g/L. The methods may include forming an anolyte by mixing the anolyte and catholyte precursor with a diluting solution. The diluting solution may be or include deionized water. The anolyte may be characterized by a copper ion concentration of greater than or about 60.0 g/L. The anolyte may be characterized by an acid concentration of less than or about 20.0 g/L. The methods may include forming a catholyte by mixing the anolyte and catholyte precursor with additional electrolyte feedstock and evaporating water. The catholyte may be characterized by a copper ion concentration of greater than or about 60.0 g/L. The catholyte may be characterized by an acid concentration of greater than or about 90.0 g/L. A temperature may be maintained at greater than or about 40° C. while forming the anolyte and catholyte precursor. The methods may include removing a portion of the acidic solution from the second compartment and replacing with a fresh acidic solution. The fresh acidic solution may maintain a hydrogen ion concentration in the second compartment. The methods may include providing additional electrolyte feedstock or additional acidic solution to a third compartment of the electrochemical cell. The second compartment and third compartment may be separated by a membrane. The first compartment and the second compartment of the electrochemical cell may be existing plating chamber compartments.

Embodiments of the present disclosure may encompass electroplating methods. The methods may include providing an electrolyte feedstock to a first compartment and a second compartment of an existing plating chamber. The first compartment and second compartment may be separated by a membrane. The methods may include applying a current to an anode positioned in the existing plating chamber. The anode may be disposed proximate the first compartment and across from the membrane. The methods may include increasing a copper ion concentration in the electrolyte feedstock in the first compartment to form a catholyte. The methods may include directing the catholyte to a storage tank in fluid communication with the existing plating chamber. The methods may include providing a dilute electrolyte feedstock to the first compartment. The methods may include increasing a copper ion concentration in the electrolyte feedstock in the first compartment to form an anolyte.

In some embodiments, the methods may include, subsequent to forming the anolyte, directing the catholyte from the storage tank to a catholyte tank. The methods may include directing the anolyte from the first compartment to an anolyte tank. The methods may include, subsequent to forming the anolyte, transitioning the existing plating chamber to production mode. The catholyte and the anolyte may each be characterized by a copper ion concentration of greater than or about 65.0 g/L. The current applied to the anode of the existing plating chamber may be greater than or about 40 ampere. A temperature may be maintained at greater than or about 40° C. while forming the catholyte and the anolyte. The existing plating chamber may be operable to electroplate copper material from the catholyte onto a substrate.

Embodiments of the present disclosure may encompass electroplating methods. The methods may include transitioning an existing plating chamber from production mode to up concentration mode. The methods may include providing an electrolyte feedstock to a first compartment and a second compartment of the existing plating chamber. The first compartment and second compartment are separated by a membrane. The methods may include applying a current to an anode positioned in the existing plating chamber. The anode may be disposed proximate the first compartment and across from the membrane. The methods may include increasing a copper ion concentration in the electrolyte feedstock in the first compartment to form a catholyte. The methods may include directing the catholyte to a storage tank in fluid communication with the existing plating chamber. The methods may include providing a dilute electrolyte feedstock to the first compartment. The methods may include increasing a copper ion concentration in the anolyte precursor to form an anolyte. The methods may include transitioning the existing plating chamber to from up concentration mode to production mode.

In some embodiments, the catholyte and the anolyte may each be characterized by a copper ion concentration of greater than or about 65.0 g/L.

Such technology may provide numerous benefits over conventional technology. For example, the present technology may create and maintain electroplating operations a high metal ion concentrations that increase the rates at which metals are electroplated onto substrates. Additionally, the present technology may can reduce the amount of metal-ion-containing starting solution needed to increase the metal ion concentration in the catholyte of an electroplating bath by forming an anolyte and catholyte precursor. These and other embodiments, along with many of their advantages and features, are described in more detail in conjunction with the below description and attached figures.

BRIEF DESCRIPTION OF THE DRAWINGS

A further understanding of the nature and advantages of the disclosed embodiments may be realized by reference to the remaining portions of the specification and the drawings.

Figure 1:
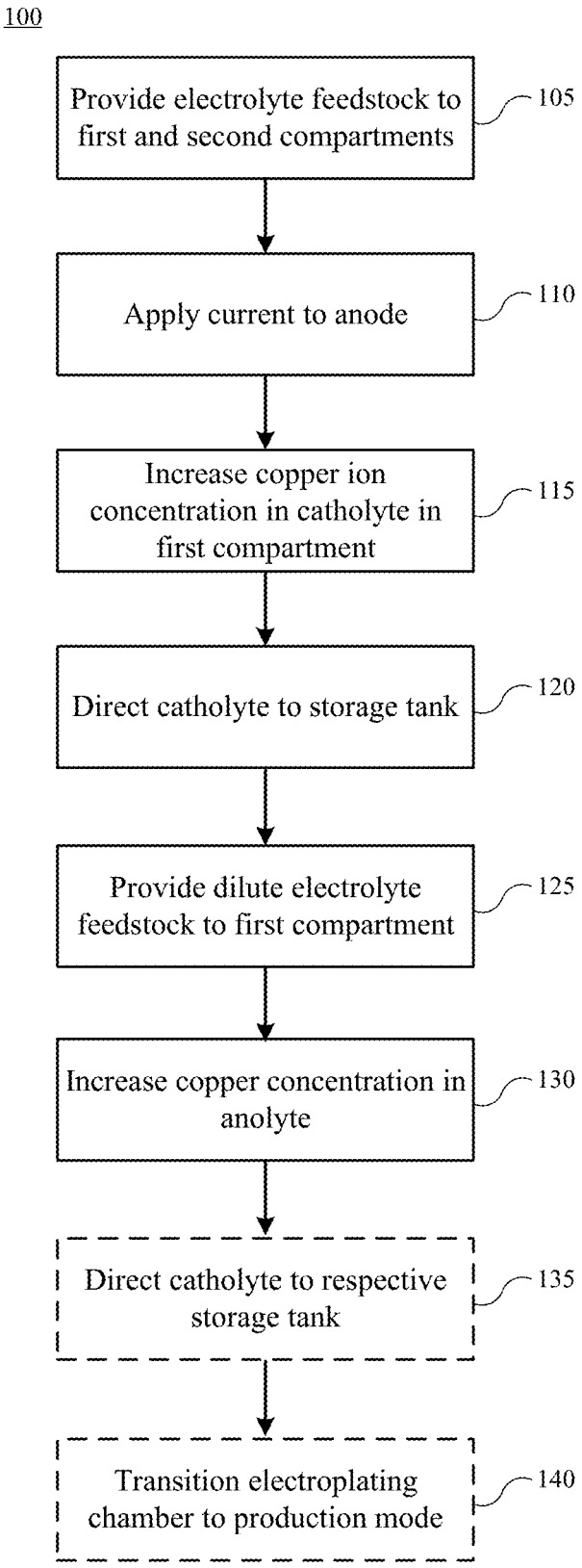
FIG. 1 shows exemplary operations in a method of operating an electroplating system according to some embodiments of the present technology.

Several of the figures are included as schematics. It is to be understood that the figures are for illustrative purposes, and are not to be considered of scale unless specifically stated to be of scale. Additionally, as schematics, the figures are provided to aid comprehension and may not include all aspects or information compared to realistic representations, and may include exaggerated material for illustrative purposes.

In the figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION

The metal deposition rate for many electroplated metals increases with higher concentrations of the metal ion in aqueous solution. Conventional techniques to increase the metal ion concentration of an aqueous electroplating solution include adding more starting liquid to the electroplating solution and evaporating some of the water from the solution. Evaporation increases both the metal ion concentration and acid concentration. Metal compounds, such as metal salts, could be dissolved to increase metal ion concentration, but this is not always possible in electroplating systems. Unfortunately, each of these techniques create problems for electroplating systems that use anolyte and catholyte solutions separated by an ion selective membrane that passes metal ions from the anolyte to the catholyte where metal plating on a substrate surface occurs.

In electroplating systems that include both an anolyte and catholyte solution, the increase in metal ion concentration normally targets the catholyte because of its direct contact with the electroplating surfaces of the substrate. For most starting liquids, the added metal ions also come with added acid. The added acid in the anolyte can reduce the rate at which metal ions from the anolyte are transported across the ion selective membrane to the catholyte. As the acidity in the anolyte increases, the rate of metal ion transport from anolyte to catholyte can be reduced by 50% or more.

Embodiments of the present technology address these problems by conditioning anolytes and catholytes at elevated temperatures, which may increase the metal ion concentrations thereof. In embodiments, the anolytes and catholytes may be conditioned in existing electroplating chambers. This may reduce the amount of equipment needed for electroplating operations. In additional embodiments, an anolyte and catholyte precursor may be formed, which may then be used to form separate anolytes and catholytes. Such embodiments may permit electroplating operations at metal ion concentrations that are higher those found in conventional technologies and may increase throughput in electroplating operations.

FIG. 1 shows exemplary operations of an electroplating method 100 according to some embodiments of the present technology. The method may be performed in a variety of processing systems, including the electroplating systems according to embodiments of the present technology described below, which include exemplary electroplating system 200 shown in FIG. 2. For illustration purposes, exemplary operations of method 100 will be described in conjunction with the relevant components of electroplating system 200. It will be appreciated that method 100 may also include one or more optional operations, which may or may not be specifically associated with some embodiments of methods according to the present technology. It will also be appreciated that any of the electroplating systems operated according to method 100 may also include one or more the additional components or features discussed throughout the present disclosure.

Figure 2:
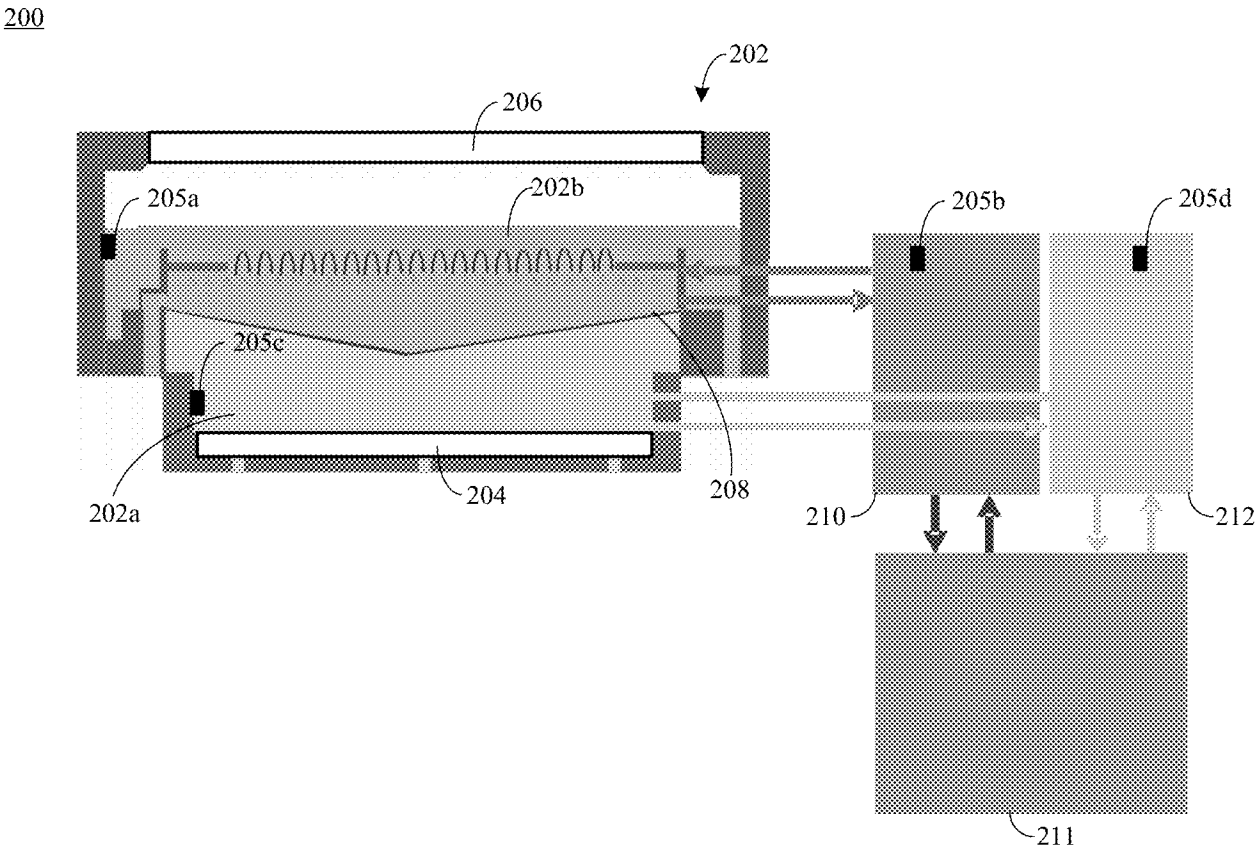
FIG. 2 shows a schematic view of an electroplating processing system according to some embodiments of the present technology.

Prior to the initiation of method 100, the system 200, specifically an electroplating chamber 202 of the system 200, may be in a tool production mode. While only one electroplating chamber 202 is depicted in FIG. 2, it is contemplated that the system 200 may include any number of electroplating chambers, such as two chambers, three chambers, four chambers, five chambers, ten chambers, fifteen chambers, twenty chambers, or more. Prior to the initiation of method 100, the electroplating chamber 202 may be in operation to electroplate a material onto a substrate or wafer. Method 100 may use the existing system 200 and the existing electroplating chamber 202 to condition and form both a catholyte solution and an anolyte solution for use during the tool production mode. Accordingly, prior to method 100, the system 200 may be transitioned from the tool production mode to an up concentration mode. Method 100 may include providing an electrolyte feedstock to the existing electroplating chamber 202 at operation 105. The electrolyte feedstock may be provided to a first compartment 202*a* of the electroplating chamber 202 and to a second compartment 202*b* of the electroplating chamber 202. However, it is contemplated that recycled catholyte and/or recycled anolyte may be provided to either of the first compartment 202*a* and/or the second compartment 202*b* in the alternative to or in addition to the electrolyte feedstock. In embodiments, an acidic solution may be provided to the second compartment 202*b* of the electroplating chamber 202. Regardless of the material, the second compartment 202*b* may contain both acid and metal ions. The second compartment 202*b* could contain fresh virgin makeup solution (VMS) or it could contain used catholyte from previous production operations. The first compartment 202*a* and the second compartment 202*b* of the electroplating chamber 202 may be separated by an ion selective membrane 208. The ion selective membrane 208 may selectively pass cations between first compartment 202*a* and the second compartment 202*b* of the electroplating chamber 202 while blocking the migration of other components between first compartment 202*a* and the second compartment 202*b* of the electroplating chamber 202.

To transfer the electroplating chamber 202 from the tool production mode to the up concentration mode, a burn-in plate 206 may be positioned in the electroplating chamber 202. Furthermore, bulk plating material 204, such as metal pellets for example, may be provided in the electroplating chamber 202. The bulk plating material 204 may simply be referred to as an anode. More specifically, the burn-in plate 206 may be positioned in or proximate to the second compartment 202*b*. The bulk plating material 204 may be positioned in or proximate to the first compartment 202*a*.

The electrolyte feedstock may be any solution for forming a catholyte solution and an anolyte solution. The electrolyte feedstock may be characterized by a metal ion concentration of less than or about 60.0 g/L, such as less than or about 58.0 g/L, less than or about 56.0 g/L, less than or about 54.0 g/L, less than or about 52.0 g/L, less than or about 50.0 g/L, less than or about 48.0 g/L, less than or about 46.0 g/L, less than or about 44.0 g/L, less than or about 42.0 g/L, less than or about 40.0 g/L, or less. Furthermore, the electrolyte feedstock may be characterized by an acid concentration of less than or about 120.0 g/L, such as less than or about 118.0 g/L, less than or about 116.0 g/L, less than or about 114.0 g/L, less than or about 112.0 g/L, less than or about 110.0 g/L, less than or about 108.0 g/L, less than or about 106.0 g/L, less than or about 104.0 g/L, less than or about 102.0 g/L, less than or about 100.0 g/L, or less. The electrolyte feedstock may be selected depending on the desired metal ion concentration and acid concentration of the catholyte and the anolyte.

During method 100, the electrolyte feedstock may be continuously circulated between the first compartment 202*a* and the second compartment 202*b* of the electroplating chamber 202. During circulation, the electrolyte feedstock in each of the first compartment 202*a* and the second compartment 202*b* of the electroplating chamber 202 may remain isolated from each other. Each electrolyte feedstock may be recirculated within its own compartment, but not between compartments. Specifically, the electrolyte feedstock in the first compartment 202*a* may continuously circulate across the bulk plating material 204. The electrolyte feedstock in the second compartment 202*b* may continuously circulate across the burn-in plate 206.

The method 100 may include applying a current to the anode at operation 110. The current applied to the anode of the existing plating chamber may be greater than or about 10 ampere. In systems 200 having more than one chamber, the current applied to the system may be scaled based on the number of electroplating chambers 202 in use. Higher currents may increase the amount of metal ions generated by the anode. Accordingly, higher currents may increase the rate of copper ion generation. Accordingly, the current applied to the anode of the existing electroplating chamber 202 may be greater than or about 15 ampere, greater than or about 20 ampere, greater than or about 25 ampere, greater than or about 30 ampere, greater than or about 35 ampere, greater than or about 40 ampere, greater than or about 45 ampere, greater than or about 50 ampere, greater than or about 55 ampere, or more. During operation 110, metal ions from the anode may be concentrated into the electrolyte feedstock in the first compartment 202*a*. Additionally, a portion of metal ions in the second compartment 202*b* may be plated onto the burn-in plate 206.

The method 100 may include increasing a metal ion, such as a copper ion, concentration in the electrolyte feedstock in the first compartment 202*a* to form a catholyte at operation 115. As the metal ion concentration increases in the electrolyte feedstock, the increased metal ion solution may be referred to as a forming catholyte. The metal ion concentration of the forming catholyte may be measured by a metal ion sensor 205*a* positioned in the first compartment 202*a* electroplating chamber 202. The metal ion sensor 205*a* may be in fluid contact with the electrolyte feedstock/forming catholyte. The metal ion concentration in the forming catholyte may be increased until the metal ion concentration meets a desired threshold. In embodiments, the desired metal ion concentration threshold may be greater than or about 65.0 g/L, greater than or about 67.5 g/L, greater than or about 70.0 g/L, greater than or about 72.5 g/L, greater than or about 75.0 g/L, greater than or about 77.0 g/L, greater than or about 77.5 g/L, greater than or about 80.0 g/L, or more. During processing, the acid concentration in the forming catholyte may reduce. However, the acid concentration may be increased during subsequent processing, such as in a buffer tank after being passed out of the electroplating chamber 202. For example, a portion of the forming catholyte may be evaporated, such as a portion of water in the forming catholyte. Further, additional electrolyte feedstock and/or an acidic solution may be added to the forming catholyte to drive the metal ion concentration and/or the acid concentration to final target values.

Additional metal ion sensors 205*b*, 205*c*, and 205*d* may be disposed throughout the system 200 to monitor metal ion concentrations. Metal ion sensors 205*b*, 205*c*, and 205*d* may perform the same as sensor 205*a* and may be disposed in second compartment 202*b*, catholyte tank 210, and anolyte tank 212.

Once the electrolyte feedstock in the first compartment 202*a* of the electroplating chamber 202 reaches the desired metal ion concentration and forms a catholyte, the method 100 may include directing the catholyte to a storage tank 211 in fluid communication with the existing plating chamber 202 at operation 120. That is, operation 110 may be continued until the metal ion concentration in the electrolyte feedstock has increased to the desired metal ion concentration, forming the catholyte. The catholyte may then be stored. While the catholyte is stored, it may be driven to final metal ion concentration and acid concentration via evaporation of water and addition of electrolyte feedstock and/or an acidic solution while an anolyte is formed prior to use in the system during the tool production mode.

During the operation of method 100, and more specifically during operations 110 and 115, additional electrolyte feedstock may be added to the forming catholyte. The additional electrolyte feedstock may make up any of the forming catholyte that evaporates during method 100. Furthermore, the additional electrolyte feedstock may maintain the acid concentration of the forming catholyte.

The method 100 may also include providing a dilute electrolyte feedstock to the first compartment 202*a* after storing the catholyte at operation 125. The dilute electrolyte feedstock may be characterized by a metal ion concentration of less than or about 40.0 g/L, less than or about 38.0 g/L, less than or about 36.0 g/L, less than or about 34.0 g/L, less than or about 32.0 g/L, less than or about 30.0 g/L, less than or about 28.0 g/L, less than or about 26.0 g/L, or less. The dilute electrolyte feedstock may be characterized by an acid concentration of less than or about 70.0 g/L, less than or about 68.0 g/L, less than or about 66.0 g/L, less than or about 64.0 g/L, less than or about 62.0 g/L, less than or about 60.0 g/L, less than or about 58.0 g/L, less than or about 56.0 g/L, or less. The dilute electrolyte feedstock may be selected depending on the desired metal ion concentration and acid concentration of the final anolyte.

The method 100 may include increasing a metal ion, such as copper ion, concentration in the anolyte precursor to form an anolyte at operation 130. The metal ion concentration in the anolyte precursor may be performed in a similar or same manner as to the catholyte. Specifically, a current may be applied to the anode, which may generate metal ions to be concentrated in the anolyte precursor in the second compartment 202*b*. Furthermore, hydrogen ions may migrate across the ion selective membrane 208 at operation 130 to the anolyte precursor in the second compartment 202*b*. The metal ion concentration in the anolyte precursor may be increased until the metal ion concentration meets a desired threshold. Similarly, the acid concentration in the anolyte precursor may be reduced until the acid concentration meets a desired threshold. In embodiments, the desired metal ion concentration threshold may be greater than or about 65.0 g/L, greater than or about 67.5 g/L, greater than or about 70.0 g/L, greater than or about 72.5 g/L, greater than or about 75.0 g/L, greater than or about 77.0 g/L, greater than or about 77.5 g/L, greater than or about 80.0 g/L, or more. Additionally, operation 130 may be continued until the acid concentration meets a desired threshold. In embodiments, the anolyte may be characterized by an acid concertation of less than or about 10.0 g/L, less than or about 9.0 g/L, less than or about 8.0 g/L, less than or about 7.0 g/L, less than or about 6.0 g/L, less than or about 5.0 g/L, less than or about 4.0 g/L, less than or about 3.0 g/L, less than or about 2.0 g/L, less than or about 1.0 g/L, or less.

Once the anolyte precursor in the first compartment 202*a* of the electroplating chamber 202 reaches the desired metal ion concentration and acid concentration and forms an anolyte, the method 100 may include housing the anolyte in storage tank 212 in fluid communication with the existing plating chamber 202. That is, operation 130 may be continued until the metal ion concentration in the anolyte precursor has increased to a desired metal ion concentration and the acid concentration has reduced to a desired acid concentration, forming the anolyte. The anolyte may then be stored prior to use in the system during the tool production mode. For example, the anolyte may be directed to or stored in storage tank 212 while the electroplating chamber 202 is converted back to production mode.

During the operation of method 100, a temperature within some or all of the components may be maintained at greater than or about 40° C. At temperatures less than 40° C., the solubility of metal ions may be reduced. Additionally, at temperatures less than 40° C. viscosity of the catholyte and/or anolyte may increase such as to a point where the solutions become difficult to transport. Accordingly, the temperature may be maintained at greater than or about 42° C., greater than or about 44° C., greater than or about 46° C., greater than or about 48° C., greater than or about 50° C., or more.

The catholyte may be transferred to its respective storage tank at optional operation 135. For example, the catholyte may be transferred to storage tank 210, which may be referred to as a catholyte tank. The anolyte may already reside in the storage tank 212, which may be referred to as an anolyte tank, at the end of operation 130. Tank 211 may be an intermediate buffer or storage tank that may be used after preparation of the catholyte and during preparation of the anolyte. That is, the prepared catholyte may be temporarily stored in tank 211 during anolyte production. As previously discussed, while stored in tank 211, the catholyte may be driven to final metal ion concentration and acid concentration targets via evaporation and electrolyte feedstock and/or acidic solution additions. After the anolyte is prepared, it resides in anolyte tank 212, and the catholyte may be transferred from tank 211 to tank 210. The sacrificial dilute electrolyte feedstock used in first compartment 202*a* may be drained before the catholyte can be transferred from tank 211 to tank 210.

After forming the catholyte and the anolyte, the electroplating chamber 202 may be transitioned from the up concentration mode to the tool production mode at optional operation 140. After being transitioned back to the tool production mode, the electroplating chamber 202 may be used to deposit metal material using the formed catholyte and anolyte. For example, the electroplating chamber 202 may be operable to electroplate metal material, such as copper material, from the formed catholyte onto a substrate or wafer.

Figure 3:
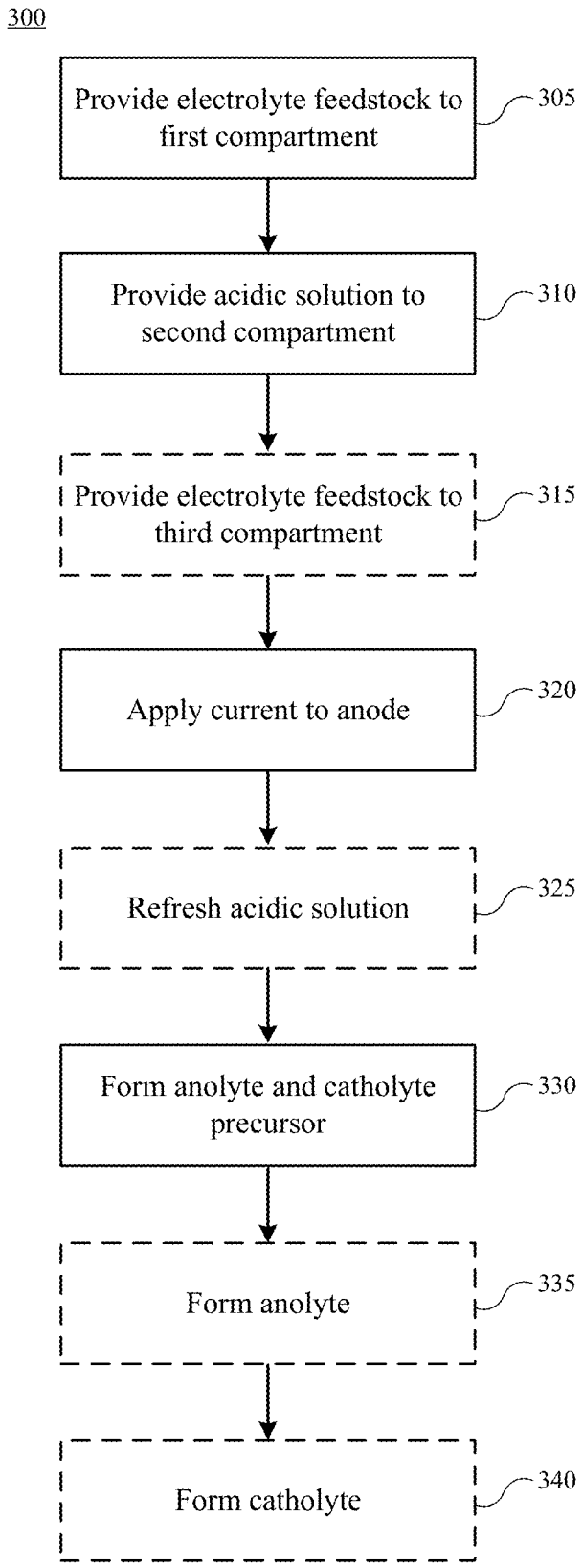
FIG. 3 shows exemplary operations in another method of operating an electroplating system according to some embodiments of the present technology.

FIG. 3 shows exemplary operations of an electroplating method 300 according to some embodiments of the present technology. The method may be performed in a variety of processing systems, including the electroplating systems according to embodiments of the present technology previously described or described below, which include exemplary electroplating system 200 shown in FIG. 1 and exemplary electroplating system 400 shown in FIG. 4. For illustration purposes, exemplary operations of method 300 will be described in conjunction with the relevant components of electroplating system 400. It will be appreciated that method 300 may also include one or more optional operations, which may or may not be specifically associated with some embodiments of methods according to the present technology. It will also be appreciated that any of the electroplating systems operated according to method 300 may also include one or more the additional components or features discussed throughout the present disclosure. Method 300 may be performed in an external electroplating system 400, which does not require production interruption to use existing production electroplating chambers. Note: Alternatively, method 300 may also be performed using the existing plating chambers, such as electroplating system 200, in a two-compartment mode. However, using existing plating chambers requires production interruption.

Method 300 may include providing an electrolyte feedstock to a first compartment 98 of an electrochemical cell 74 at operation 305. The electrolyte feedstock may be include any of the features or characterizations of the electrolyte feedstock previously discussed with regard to FIGS. 1-2. For example, the electrolyte feedstock may include a metal, such as copper, and may be characterized by a metal ion concentration. In embodiments, the electrolyte feedstock may be characterized by a copper ion concentration of less than or about 60.0 g/L. Furthermore, the electrolyte feedstock may be characterized by an acid concentration of less than or about 120.0 g/L.

The first compartment 98 of the electrochemical cell may be separated from a second compartment 106 of the electrochemical cell 74 by a membrane 104, such as an ion selective membrane. The membrane 104 may selectively pass cations between first compartment 98 and the second compartment 106 of the electrochemical cell 74 while blocking the migration of other components between first compartment 98 and the second compartment 106 of the electrochemical cell 74. Similar to system 200, a burn-in plate 114 may be positioned in the electrochemical cell 74. Furthermore, bulk plating material 92, such as metal pellets for example, may be provided in the electrochemical cell 74. The bulk plating material 92 may simply be referred to as an anode. The bulk plating material 92 may be positioned in or proximate to the first compartment 98. In embodiments having two compartments, burn-in plate 114 may be positioned in or proximate to second compartment 106. In embodiments having a third compartment 112, burn-in plate 114 may be positioned in or proximate to third compartment 112.

At operation 310, in embodiments having two compartments, the method 300 may include providing electrolyte feedstock or an acidic solution to the second compartment 106 of the electrochemical cell 74. In embodiments having three compartments, the method 300 may include providing an acidic solution to the second compartment 106 of the electrochemical cell 74. In embodiments, the acidic solution may include sulfuric acid diluted in water, such as deionized water, but it is contemplated that other acids may be used in addition or alternatively to sulfuric acid. The acidic solution may be characterized by an acid concentration of less than or about 120.0 g/L, such as less than or about 118.0 g/L, less than or about 116.0 g/L, less than or about 114.0 g/L, less than or about 112.0 g/L, less than or about 110.0 g/L, less than or about 108.0 g/L, less than or about 106.0 g/L, less than or about 104.0 g/L, less than or about 102.0 g/L, less than or about 100.0 g/L, or less.

Figure 4:
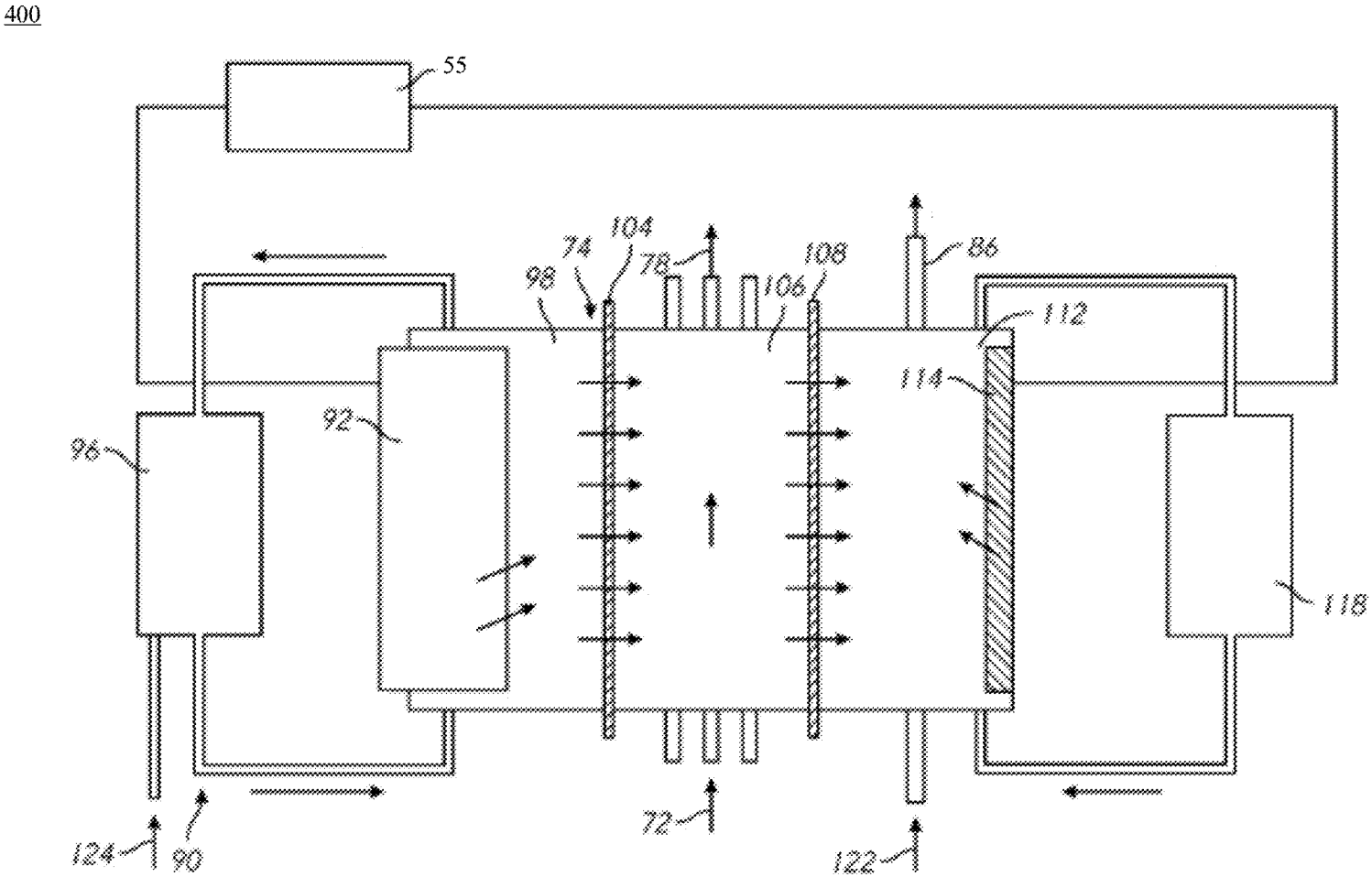
FIG. 4 shows a schematic view of a replenish assembly according to some embodiments of the present technology.

During method 300, the electrolyte feedstock may be continuously circulated between the first compartment 98 of the electrochemical cell 74, such as through the electrolyte feedstock loop 90. The electrolyte feedstock may be provided via conduit 124 to electrolyte feedstock tank 96. The electrolyte feedstock in the first compartment 98 may continuously circulate across the bulk plating material 92 and may pass through the electrolyte feedstock tank 96 during method 300. The solution in the second compartment 106 (or third compartment 112, when present) may continuously circulate across the burn-in plate 114. As shown in FIG. 4, material in the third compartment 112 may be provided via conduit 122 and may be circulated through tank 118 during method 300. Material in the second compartment 106 may be provided via conduit 72 and may be circulated through a tank (not shown) during method 300. More specifically conduit 72 may be connected to one side of the second compartment 106 and the conduit 78 may be connected to the other side of the second compartment 106, which may allow circulation of material in the second compartment 106.

As previously discussed, in embodiments, the electrochemical cell 74 may include a third compartment 112. The third compartment 112 may be separated from the second compartment 106 by a membrane 108, such as a second ion selective membrane. At optional operation 315, the method 300 may include providing additional electrolyte feedstock or additional acidic solution to a third compartment 112. The electrolyte feedstock or acidic solution provided to the third compartment 112 may be the same or similar to the electrolyte feedstock provided to the first compartment 98 or the acidic solution provided to the second compartment 106.

The method 300 may include applying a current to the anode at operation 320. The negative or cathode of a power supply 55, such as a DC power supply, may be electrically connected to the burn-in plate 114. The positive or anode of the power supply 55 may be electrically connected to the bulk plating material 92 or metal in the replenish assembly anolyte compartment 98 applying or creating a voltage differential across the electrochemical cell 74. The current applied to the anode of the electrochemical cell may be greater than 800 ampere. Higher currents may increase the amount of metal ions generated by the anode. Accordingly, the current applied to the anode of the existing electrochemical cell 74 may be greater than or about 900 ampere, greater than or about 1000 ampere, greater than or about 1100 ampere, greater than or about 1200 ampere, greater than or about 1300 ampere, greater than or about 1400 ampere, greater than or about 1500 ampere, greater than or about 1600 ampere, or more. During operation 110, metal ions from the anode may be concentrated into the electrolyte feedstock in the first compartment 98. Furthermore, during operation 110 the acid concentration may decrease compared to the starting concentration in the electrolyte feedstock.

During operation, the acid concentration in the acidic solution, either in the second compartment 106 or the third compartment 112, may increase or decrease. In embodiments, the method 300 may include removing, or bleeding, a portion of the acidic solution in either or both the second compartment 106 or the third compartment 112 at operation 325. The portion of the acidic solution may be removed via conduit 86, such as in the three-compartment system shown in FIG. 4. Similarly, the method 300 may include providing, or feeding, fresh acidic solution to either or both the second compartment 106 or the third compartment 112 at operation 325. By bleeding and feeding acidic solution, the acidity in the second compartment 106 and/or third compartment 112 may be maintained, which may foster formation of an anolyte and catholyte precursor.

At operation 330, the method 300 may include forming the anolyte and catholyte precursor in the first compartment 98. The anolyte and catholyte precursor may be used to form a separate anolyte and a separate catholyte. Operations 320 and 325 may be continued until the anolyte and catholyte precursor meets a desired metal ion concentration and a desired acid concentration. In embodiments, the anolyte and catholyte precursor is characterized by a copper ion concentration of greater than or about 70.0 g/L, such as greater than or about 72.0 g/L, greater than or about 74.0 g/L, greater than or about 75.0 g/L, greater than or about 76.0 g/L, greater than or about 78.0 g/L, greater than or about 80.0 g/L, greater than or about 82.0 g/L, greater than or about 84.0 g/L, greater than or about 86.0 g/L, greater than or about 88.0 g/L, greater than or about 90.0 g/L, or more.

At optional operations 335 and 340, the method 300 may include forming the anolyte and forming the catholyte, respectively. At operation 335, the anolyte may be formed by mixing the anolyte and catholyte precursor with a diluting solution. In embodiments, the diluting solution may be or include water, such as deionized water. The anolyte may be characterized by a metal ion concentration of greater than or about 60.0 g/L, such as greater than or about 62.0 g/L, greater than or about 64.0 g/L, greater than or about 66.0 g/L, greater than or about 68.0 g/L, greater than or about 70.0 g/L, greater than or about 72.0 g/L, greater than or about 74.0 g/L, greater than or about 76.0 g/L, greater than or about 78.0 g/L, greater than or about 80.0 g/L, or more. The anolyte may also be characterized by an acid concentration of less than or about 20.0 g/L, such as less than or about 15.0 g/L, less than or about 12.5 g/L, less than or about 10.0 g/L, less than or about 7.5 g/L, less than or about 5.0 g/L, less than or about 4.0 g/L, less than or about 3.0 g/L, less than or about 2.0 g/L, less than or about 1.0 g/L, or less. At operation 340, the catholyte may be formed by mixing the anolyte and catholyte precursor with additional electrolyte feedstock and evaporating water. In embodiments, a portion of the catholyte may be evaporated, which may increase the metal ion concentration and/or acid concentration. The catholyte may be characterized by a metal ion concentration of greater than or about 60.0 g/L, such as greater than or about 62.0 g/L, greater than or about 64.0 g/L, greater than or about 66.0 g/L, greater than or about 68.0 g/L, greater than or about 70.0 g/L, greater than or about 72.0 g/L, greater than or about 74.0 g/L, greater than or about 76.0 g/L, greater than or about 78.0 g/L, greater than or about 80.0 g/L, or more. The catholyte may also be characterized by an acid ion concentration of greater than or about 85.0 g/L, such as greater than or about 87.5 g/L, greater than or about 90.0 g/L, greater than or about 92.5 g/L, greater than or about 95.0 g/L, greater than or about 97.5 g/L, greater than or about 100.0 g/L, or more.

Embodiments of the present technology allow electroplating operations to be performed at increased metal ion concentrations in the catholyte over extended periods of time. The increased metal ion concentration increases the rate at which metal may be deposited on a substrate during electroplating operations, increasing the throughput of substrates through the electroplating systems. In embodiments, the increased metal ion concentration may be maintained for extended periods by increasing the rate at which the catholyte and anolyte may be prepared. The efficient preparation of the catholyte and anolyte precursor and/or the catholyte and the anolyte may minimize downtime of the system and may further increase throughput.

In the preceding description, for the purposes of explanation, numerous details have been set forth in order to provide an understanding of various embodiments of the present technology. It will be apparent to one skilled in the art, however, that certain embodiments may be practiced without some of these details, or with additional details.

Having disclosed several embodiments, it will be recognized by those of skill in the art that various modifications, alternative constructions, and equivalents may be used without departing from the spirit of the embodiments. Additionally, a number of well-known processes and elements have not been described in order to avoid unnecessarily obscuring the present technology. Accordingly, the above description should not be taken as limiting the scope of the technology.

Where a range of values is provided, it is understood that each intervening value, to the smallest fraction of the unit of the lower limit, unless the context clearly dictates otherwise, between the upper and lower limits of that range is also specifically disclosed. Any narrower range between any stated values or unstated intervening values in a stated range and any other stated or intervening value in that stated range is encompassed. The upper and lower limits of those smaller ranges may independently be included or excluded in the range, and each range where either, neither, or both limits are included in the smaller ranges is also encompassed within the technology, subject to any specifically excluded limit in the stated range. Where the stated range includes one or both of the limits, ranges excluding either or both of those included limits are also included. Where multiple values are provided in a list, any range encompassing or based on any of those values is similarly specifically disclosed.

As used herein and in the appended claims, the singular forms "a", "an", and "the" include plural references unless the context clearly dictates otherwise. Thus, for example, reference to "a feedstock" includes a plurality of such feedstocks, and reference to "the electrochemical cell" includes reference to one or more electrochemical cells and equivalents thereof known to those skilled in the art, and so forth.

Also, the words "comprise(s)", "comprising", "contain(s)", "containing", "include(s)", and "including", when used in this specification and in the following claims, are intended to specify the presence of stated features, integers, components, or operations, but they do not preclude the presence or addition of one or more other features, integers, components, operations, acts, or groups.

What is claimed is:

1. An electroplating method comprising:

providing an electrolyte feedstock to a first compartment and a second compartment of an existing plating chamber, wherein the first compartment and second compartment are separated by a membrane;

applying a current to an anode positioned in the existing plating chamber, wherein the anode is disposed proximate the first compartment and across from the membrane;

increasing a copper ion concentration in the electrolyte feedstock in the first compartment to form a catholyte;

directing the catholyte to a storage tank in fluid communication with the existing plating chamber;

providing a dilute electrolyte feedstock to the first compartment;

increasing a copper ion concentration in the electrolyte feedstock in the first compartment to form an anolyte; and subsequent to forming the anolyte, directing the catholyte from the storage tank to a catholyte tank.

2. The electroplating method of claim 1, further comprising:

subsequent to forming the anolyte, transitioning the existing plating chamber to production mode.

3. The electroplating method of claim 1, wherein:

the catholyte and the anolyte are each characterized by a copper ion concentration of greater than 65.0 g/L.

4. The electroplating method of claim 1, wherein the current applied to the anode of the existing plating chamber is greater than 10 amperes.

5. The electroplating method of claim 1, wherein a temperature is maintained at greater than 40° C. while forming the catholyte and the anolyte.

6. The electroplating method of claim 1, wherein the existing plating chamber is operable to electroplate copper material from the catholyte onto a substrate.

7. An electroplating method comprising:

transitioning an existing plating chamber from production mode to up concentration mode;

providing an electrolyte feedstock to a first compartment and a second compartment of the existing plating chamber, wherein the first compartment and second compartment are separated by a membrane;

applying a current to an anode positioned in the existing plating chamber, wherein the anode is disposed proximate the first compartment and across from the membrane;

increasing a copper ion concentration in the electrolyte feedstock in the first compartment to form a catholyte;

directing the catholyte to a storage tank in fluid communication with the existing plating chamber;

providing a dilute electrolyte feedstock to the first compartment;

increasing a copper ion concentration in the electrolyte feedstock in the second compartment to form an anolyte; and transitioning the existing plating chamber from up concentration mode to production mode.

8. The electroplating method of claim 7, wherein the catholyte and the anolyte are each characterized by a copper ion concentration of greater than or about 65.0 g/L.

* * * * *